United States Patent [19]

Egland

[11] 3,986,675

[45] Oct. 19, 1976

[54] SAND CONDITIONER ASSEMBLY

[76] Inventor: Ordean E. Egland, 161 Mission Lane, Bloomington, Minn. 55420

[22] Filed: July 11, 1975

[21] Appl. No.: 595,079

[52] U.S. Cl. ..... 241/30; 15/88; 241/230; 241/236; 241/DIG. 10

[51] Int. Cl.[2] ..... B02C 4/32

[58] Field of Search ..... 15/3.12, 21 D, 77, 88, 15/384; 241/30, 230, 235, 236, 60.1, DIG. 10

[56] References Cited

UNITED STATES PATENTS

| | | | |
|---|---|---|---|
| 722,885 | 3/1903 | Patterson | 241/DIG. 10 |
| 1,630,136 | 5/1927 | Ross | 15/3.12 |
| 2,334,714 | 11/1943 | Knight | 15/21 D X |
| 2,412,430 | 12/1946 | Suelflow | 15/3.12 |
| 3,117,333 | 1/1964 | Murray et al. | 15/77 X |
| 3,346,197 | 10/1967 | Sagar | 241/235 X |
| 3,786,998 | 1/1974 | Risko et al. | 241/235 X |

*Primary Examiner*—Roy Lake
*Assistant Examiner*—Howard N. Goldberg
*Attorney, Agent, or Firm*—Schroeder Siegfried Ryan & Vidas

[57] ABSTRACT

A method and apparatus for mold sand conditioning which includes the directing of mold sand between bristles of counterrotating brushes where the bristles are intertwined and the sand is forced into the brushes to be finely divided and aerated upon discharge. The conditioning assembly includes an enclosing housing with a driving brush journaled therein and connected to a driving motor. A driven brush is mounted in the housing and slidably adjustable relative to the first brush to maintain a predetermined overlap between the bristles to insure the milling or conditioning operation on the mill sand.

7 Claims, 4 Drawing Figures

12

50
11
65
10
80
25
15
20

55
26
95
68
35
106
105
50
32
38
65
38
105
35
55
26
68
95
30
35
106
52
66
25
90
90
80

SAND CONDITIONER ASSEMBLY

My invention relates to method and apparatus for conditioning mold sand and more particularly to a simplified conditioning apparatus for pulvarizing globules of sand and reducing such sand to a very find state and aerating the same for reuse as mold sand in a foundry.

The problems of reconditioning sand from molds for reuse are well recognized. Such sand, because of binding material, moisture and the effect of heat tend to form globules or chunks which must be finely divided and aerated so that it will be in the condition of a fine state for reuse in molds necessary to provide for smooth castings. In the past, complex grinding, screening and milling apparatus have been employed for this purpose.

The present invention is directed to an improved and simplified conditioning assembly and method of conditioning mold sand which requires only the passing of the globules of sand through bristles of high speed rotating brushes which will perform a shearing, disintegrating action and pulverizing action reducing the sand to the finest grains while aerating the same such that the conditioned sand will be in a fine state and will not have any further tendency to stick together until reuse in molds. The improved apparatus comprises of a pair of rotating brushes in a housing into which mold sand is directed with the bristles of the brushes overlapping a slight mount such that the sand must pass through and around the bristles of the brushes to disintegrate the same, with the brushes being rotated at high speeds such that the sand will be discharged by high centrifugal force to form the further disintegrating and aerating conditioning. The improved conditioning apparatus provides for means for driving brushes in a counterrotating direction, one brush driving the other because of the contacting relationship and with one brush being adjustable relative to the other to maintain a predetermined overlap of bristles.

It is therefore an object of this invention to provide an improved and simplified method and apparatus for conditioning mold sand.

Another object of this invention is to provide an improved mold sand conditioning assembly in the form of a pair of counterrotating and contacting brushes requiring the mold sand to pass between and through the bristles of the same.

A further object of this invention is to provide in a mold sand conditioning apparatus means for driving the counterrotating brushes from a single motor and at the same speed.

A further object of this invention is to provide in a mold sand conditioning apparatus a simplied arrangement for adjusting a contacting relationship between the counterrotating brushes.

These and other objects of this invention will become apparent from the reading of the attached description together with the drawings wherein.

Figure 1:
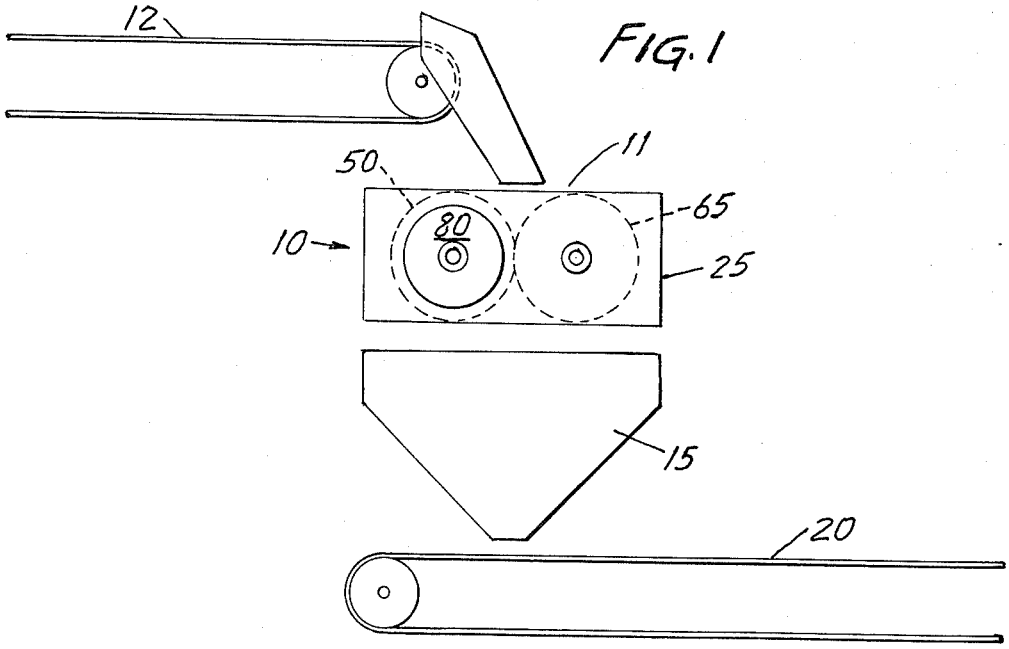
FIG. 1 is a schematic view of the mold sand conditioning apparatus in a sand handling system in a foundry.

In FIG. 1 I have shown schematically a mold sand conditioning apparatus, indicated generally at 10, which receives core sand from a foundry area through means, such as is indicated by the conveyor 12, feeding the sand to be conditioned directly into the conditioning apparatus 10 at an inlet of the same. The sand taken from the molds after the casting have been removed has the characteristics of hard chunks or lumpy texture due to the binder, moisture or other impurities as well as the heat. Such chunks must be broken down into a finely divided state before the sand may be used again in the making of molds. The conditioning apparatus, shown at 10, replaces the conventional grinding, screening and milling apparatus presently in use and the single machine which receives the sand for conditioning in a single operation conditions the sand and discharges it, as indicated at 15, onto a conveyor 20 back into a storage area or directly for reuse in the metal casting foundry operation. The conditioned sand is in its finely divided state and has been aerated through the operation of its conditioner so that it will not again adhere to other particles and is suitable for reuse in the making of molds for castings.

Figure 3:
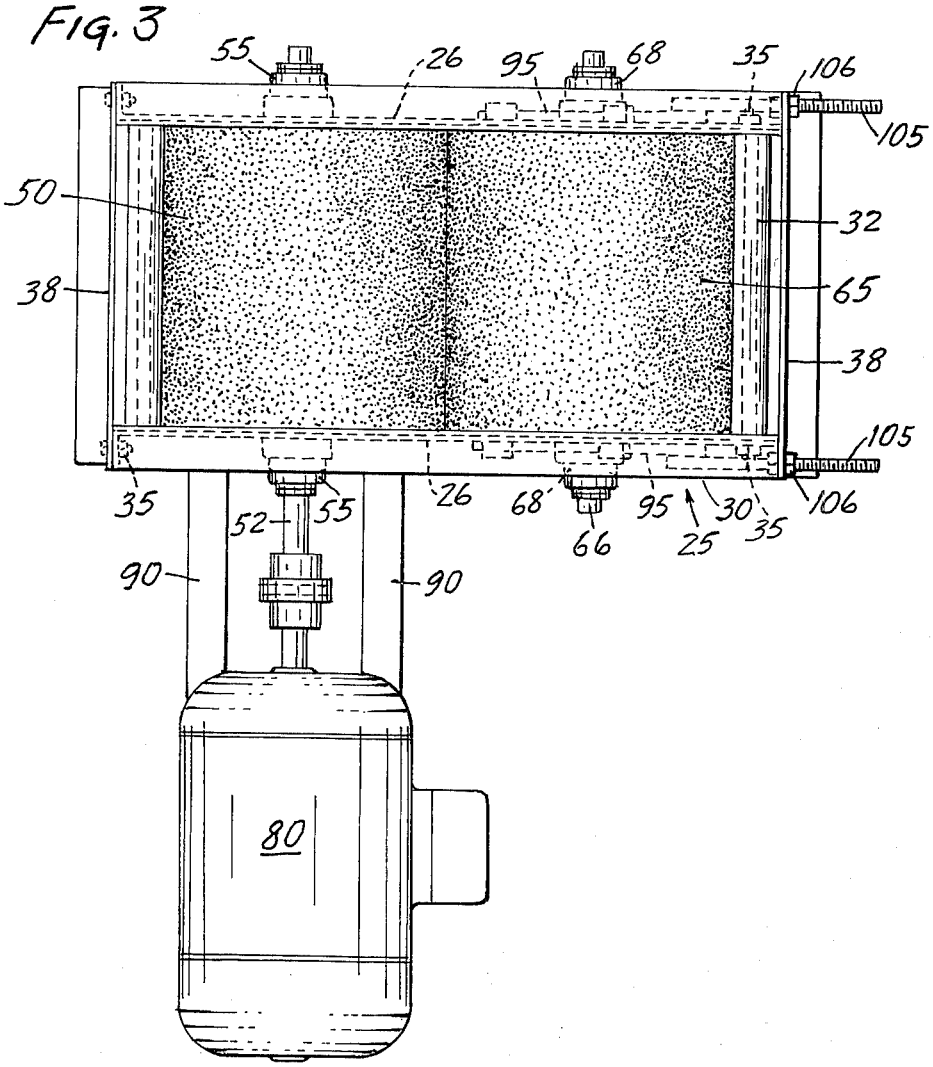
FIG. 3 is a plan view of the conditioning apparatus of FIG. 2.
Figure 2:
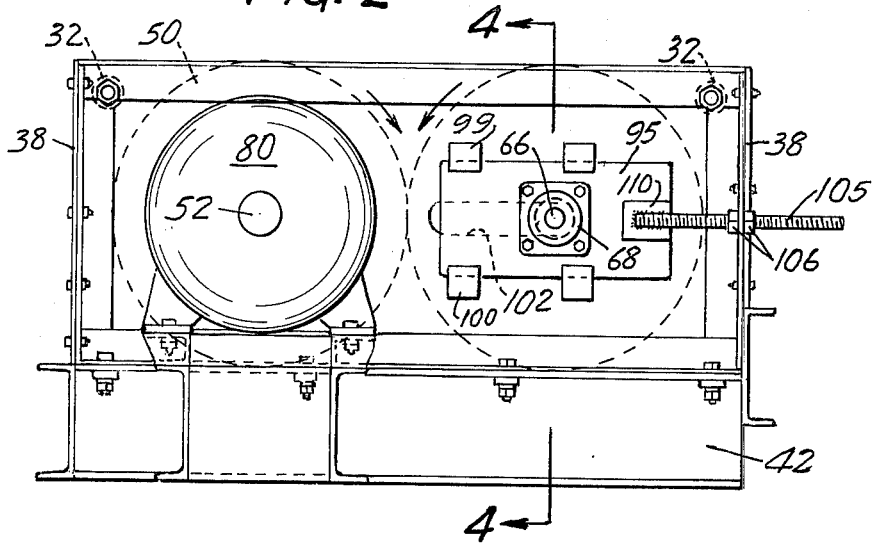
FIG. 2 is a side elevation view of the sand conditioning apparatus.
Figure 4:
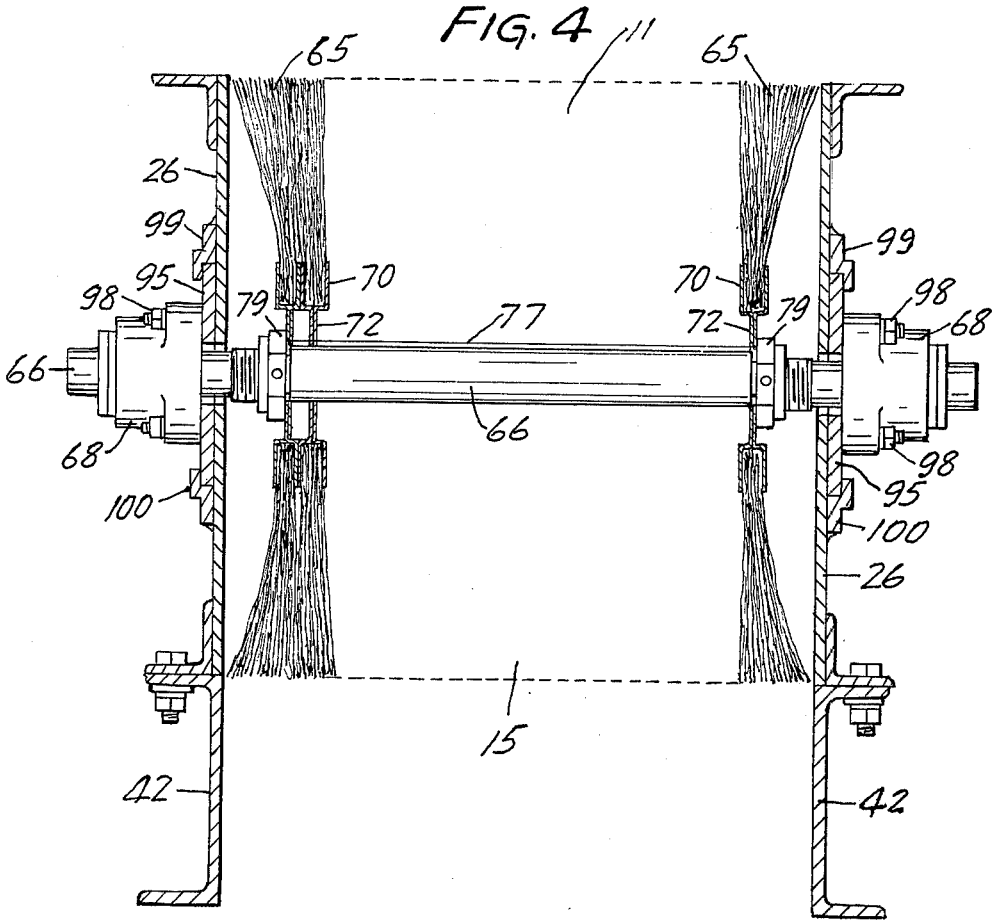
FIG. 4 is a sectional view of the sand conditioning apparatus of FIG. 2 taken along the lines 4—4 in FIG. 2.

FIGS. 2, 3, and 4 show the conditioning assembly 10. It is formed by an enclosing frame structure or enclosure 25 having a pair of steel side panels 26 on either side of the same which are held together in a rectangular angle iron frame formed by a plurality of angle iron frame members 30 and held in spaced relationship by means of spacer members 32 positioned between the same. Suitable nut and bolt means 35 hold the unit in an assembled relationship and the end panels 38 of the enclosing structure are formed of a neopreme. The enclosure or frame thus has sides and ends 26 and 38 respectively with an open top 11 and an open bottom section 15. Positioned within the enclosure is a drive brush roller 50 formed by a brush assembly which is mounted on a shaft 52 and journaled in bearing 55 mounted on the side plates 26. A similar driven brush roller 65 is positioned wihin the housing and adjacent thereto in contacting relationship therewith, the brush assembly 65 on either side of the panels 26. As will be best seen in FIG. 4, the second brush assembly, which is constructed identical with the first brush assembly, is shown in cross section as being formed of a plurality of individual brushes 70 which are annular in form and have a hub section 72 fitting over the shaft 66 and key portion 77 of the same. Suitable lock nuts 79 are positioned on either end of the shaft to hold the hub sections and hence, the brushes in an assembled relationship on the shaft. The individual brushes when combined on the shaft form a drum which extend between the side plates 26 and adjacent to the end panels 38, but slightly out of contact with the same. As will be hereinafter noted, the bristles of the brushes 70, which are steel brushes, intertwine or contact one another because of the spacing between the respective shafts 55 and 66 and the respective brush assemblies 50 and 65 thereon. The drive brush roller 50 is driven by a motor 80 which is mounted on a frame 90 attached to the frame structure 25 or angle iron portion of the frame. The motor 80 is an electric motor capable of operating at a speed of 1200 rpm and when energized rotates the roller or brush assembly 50 and the frictional contact of the bristles which overlap one another by ⅛ to 1/16 inch, preferably, will cause the second brush assembly 65 to rotate in a counterrotating direction with that of the first roller. As will be seen in FIGS. 2 and 4, the shaft 66 is mounted on a rectangular plate 95 at either ends of the shaft through bearings 60 with the plates 95 mounting the bearings 60 by a suitable nut and bolt connection 98. The plates 95 are slidably mounted on the plates 26 of the enclosure through guide members 99, 100 which are welded to the plates 26 on either side of the enclosure and guide the plates 95 for slidable movement relative thereto carrying the shaft 66 for adjusting movement. The plates 26 have slots 102 on either side of the same allowing the plates to slide and move the shaft 66 extending therebetween and hence, the brush assembly 65 mounted thereon toward the fixed or first brush assembly 50 driven by the motor 80. Thus, whenever wear occurs in the bristles of the brush assemblies due to the contacting relationship and friction, the spacing between the shafts and hence the brushes will be adjusted by moving the plates mounting the shaft 66 and hence, the brush assembly 65 toward the brush assembly 50 to insure that the overlap of ⅛ to 1/16 inch of the bristles is obtained. A suitable adjusting screw 105 is mounted on each side of the enclosure and is threaded through drive nuts 106, on either side of the frame structure, the screws being secured to the plates 95 through a welding process, as indicated at 110. Thus, the screws 105 are welded to a plate 110 which in turn is welded to the plate 95 to properly space and align the adjusting screws for simultaneously moving the shaft 66 of the brush assembly 65 toward the driving brush assembly.

The operation of the conditioner is such that the driving motor 80 drives the brush assembly 50 and the frictional engagement of its bristles with the bristles of the driven brush assembly 65 will cause rotation of the same at the same speed. As sand is fed into the inlet or upper portion 40 of the conditioner, it will be fed between the wire bristles and the lumps of sand will be broken down into its fine granulars with the sand being forced between the bristles as the brush assemblies 55 and 60 are rotated at a relatively high speed (1200 rpm). Thus, the sand lumps will be reduced to the individual granules and centrifugal force will discharge the granulated sand through the open bottom 15 at the lower extremity of the enclosure. Any sand still carried by the bristles will be rotated against or thrown against the end plates 38 which are made of neopreme rubber so as to absorb the momentum of the sand and cause the sand to fall back through gravity into the discharge area. Thus, the continuous and high speed rotation of the brushes will reduce any lumps of sand to the fine granules and aerate the same due to the high speed discharge allowing the sand to be discharged in fine granular form back into a storage area for reuse in the molding operation. No screening, milling or grinding is required and the shearing action of the steel bristles causing the sand to go between the same will provide a smooth conditioning and dividing action to reduce the sand to its fine state and aerate the same so that it will not tend to ball up or adhere to other granules after being discharged. It will therefore be suitable for immediate reuse in the molding or casting operation.

In considering this invention it should be remembered that the present disclosure is illustrative only and the scope of the invention should be determined by the appended claims.

What I claim is:

1. A sand conditioner assembly comprising, a generally rectangular housing having enclosed sides and ends with an open top defining a sand inlet and an open bottom surface defining a sand outlet, a first brush assembly mounted on a shaft and journaled in the sides of said housing, motor means mounted on a frame connected to the housing and coupled to said shaft to rotate said first brush assembly, a second brush assembly mounted on a second shaft journaled in the sides of said housing, said first and second brush assembly having bristles forming cylindrical surfaces positioned in adjacent relationship substantial filling said housing with the bristles of said brush assemblies overlapping in a contacting relationship so that rotation of the first brush assembly drives the second brush assembly and, said second shaft mounting the second brush assembly being journaled in a pair of plates positioned on the sides of said housing with the plates being slidably mounted in a slot in said housing to affect adjustment of the position of said second shaft relative to said first shaft to maintain the overlapping relationship of said bristles.

2. The sand conditioner assembly of claim 1 in which the overlap of the bristles of said first and second brush assemblies in contacting relationship ranges from 1/16 to ⅛ inch.

3. The sand conditioner assembly of claim 1 in which the first and second brush assemblies on said first and second shafts are counterrotating.

4. The sand conditioner assembly of claim 1 in which the slidable plates mounting the second shaft are coupled through threaded shafts to affect adjustment of position of the second shaft mounting the second brush assembly in the slot.

5. The sand conditioner assembly of claim 1 in which the rotation of the first shaft in driving the second brush assembly is approximately 1200 rpm.

6. The sand conditioner assembly of claim 1 in which each brush assembly is comprised of a plurality of individual annular brushes having a hub mounted on the shaft and keyed thereto for a driving relationship.

7. The method of conditioning core sand comprising, depositing hardened mold sand from molds between a pair of counterrotating brushes rotating the brushes at the same high speed and in such a manner that the bristles overlap causing the sand to enter between the bristles and around the bristles and be finely divided into granulars, and discharging the sand granulars from the brushes due to a large centrifugal force caused by the high speed rotation of the brushes.

* * * * *